United States Patent [19]

Young et al.

[11] 4,272,769

[45] Jun. 9, 1981

[54] MICROWAVE ANTENNA WITH PARABOLIC MAIN REFLECTOR

[76] Inventors: Frederick A. Young, 17502 Berlark Cir., Huntington Beach, Calif. 92649; Willard V. T. Rusch, 800 S. Hudson, Pasadena, Calif. 91106

[21] Appl. No.: 69,968

[22] Filed: Aug. 27, 1979

[51] Int. Cl.[3] ..... H01Q 19/14

[52] U.S. Cl. ..... 343/781 P; 343/840; 343/837

[58] Field of Search ..... 343/781 CA, 781 P, 781 R, 343/761, 840, 837

[56] References Cited

U.S. PATENT DOCUMENTS

| | | | |
|---|---|---|---|
| 2,419,556 | 4/1947 | Feldman | 343/837 |
| 3,792,480 | 2/1974 | Graham | 343/837 |
| 3,922,682 | 11/1975 | Hyde | 343/840 |
| 4,145,695 | 3/1979 | Gans | 343/837 |

*Primary Examiner*—David K. Moore

*Attorney, Agent, or Firm*—Nilsson, Robbins, Dalgarn, Berliner, Carson & Wurst

[57] ABSTRACT

A conical scan microwave antenna having a stationary fixed axially symmetric primary reflector consisting of any concave surface of revolution along with a spherical wave point source feed-and-subreflector assembly potentially rotatable about the axis of the primary reflector, and with the surface of the subreflecror being shaped so that the reflection of the spherical wave from the feed and off of the subreflector strikes the primary antenna and is reflected as a co-planar wavefront from every point on the primary reflector, and, further, the subreflector-and-feed assembly is located outside of the aperture of the reflected pencil beam such that for any given scan position of the subreflector, no portion of the reflected wavefront intersects the subreflector or its feed.

8 Claims, 4 Drawing Figures

FIG. 3
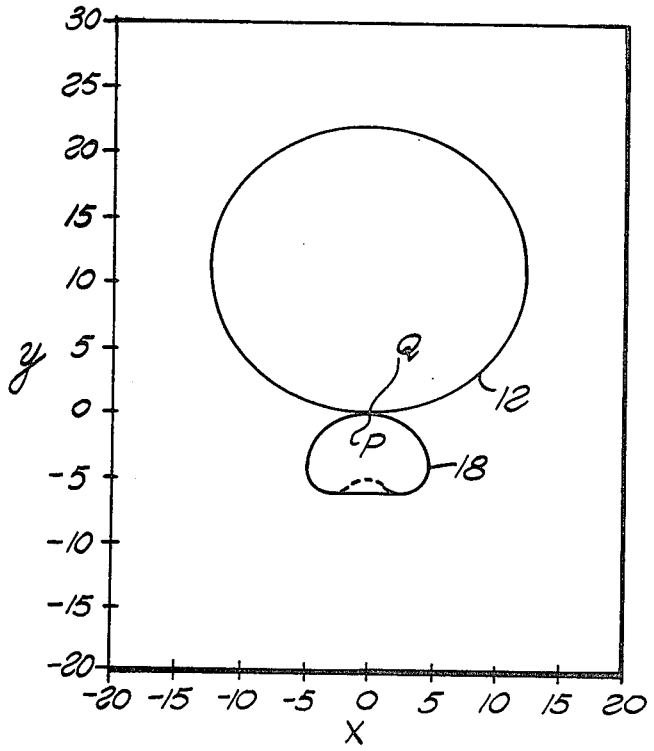
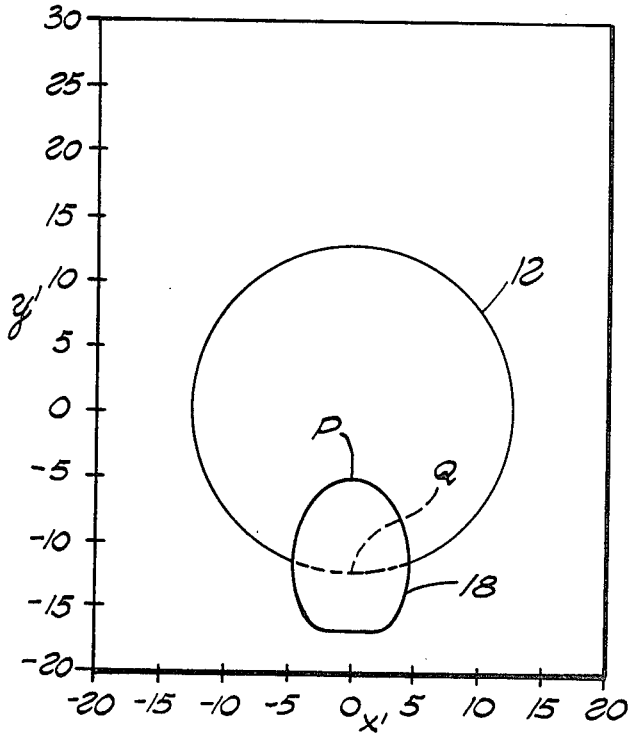
FIG. 4

MICROWAVE ANTENNA WITH PARABOLIC MAIN REFLECTOR

BACKGROUND OF THE INVENTION

The present invention relates generally to aconical scan microwave antenna for transmitting a pencil beam or receiving a plane wavefront. More particularly, this invention relates to a microwave antenna having a stationary and fixed primary reflector consisting of an axially symmetrical surface of revolution, and a spherical wave point source feed-and-subreflector assembly on the same side as the focus of the primary reflector. The subreflector and feed are positioned outside of the aperture of the plane wavefront reflected from the primary reflector and the surface of the subreflector is shaped such that the reflection off of the subreflector of the spherical wave from the feed strikes the primary reflector and is reflected thereby in a collimated co-planar wavefront from each point on the primary reflector, which is potentially scannable by rotating the subreflector-and-feed assembly about the axis of the primary reflector. Further, neither the feed nor the subreflector aperture blocks any portion of the reflected pencil beam at any position of the subreflector-feed-assembly about the axis of the primary reflector.

In the past it has been common to scan using a limited portion of a primary reflector having a surface consisting of a surface of revolution. For example, the patent to Graham, U.S. Pat. No. 3,792,480 discloses the use of a portion of a paraboloid and a portion of a hyperboloid for the primary and subreflectors to produce a collimated beam. Such portions of a paraboloid or a hyperboloid, or in fact any axially symmetrical surface of revolution, are extremely difficult to fabricate to the tolerances needed for very long range directionally accurate microwave transmission and reception, e.g., from a satellite in space orbit to earth. In addition, the subreflector is located on the axis of the surface of revolution, of which a portion is being used as the primary reflector. This limits the amount of the portion of the surface of revolution which can be used at a given time as the primary reflector without aperture blockage by the subreflector of the beam being transmitted or received. Not all of the surface of revolution can be used at once, thus decreasing, e.g., the antenna's gain and directivity. The patent to Gans, U.S. Pat. No. 4,145,695, discloses an offset subreflector Cassegrainian antenna using a paraboloid primary reflector with an astigmatic launcher in the path between the feed and subreflector, with the astigmatic launcher having a surface shaped to compensate for astigmation due to off axis scanning of the beam from the primary reflector.

Rotation of the subreflector to achieve conical scanning of the beam from a parabolic primary reflector is also known in the art as shown in the patent to Feldman, U.S. Pat. No. 2,419,556. However, severe aperture blockage exists in the design shown in the patent to Feldman because the subreflector is located in the beam aperture which is coaxial with the axis of the primary reflector.

The problems enumerated in the foregoing are not intended to be exhaustive but, rather, are among many which tend to impair the effectiveness of previously known off-axis scanning microwave antennas with the primary reflector formed by a surface of revolution. Other noteworthy problems may also exist; however, those presented above should be sufficient to demonstrate that scanning microwave antennas existing in the art have not been altogether satisfactory.

SUMMARY OF A PREFERRED EMBODIMENT OF THE INVENTION

Recognizing the need for an improved conical scanning microwave antenna, it is, therefore, a general feature of the present invention to provide a novel microwave antenna which minimizes or reduces the problems of the type previously noted.

A feature of the present invention resides in using a subreflector having a surface which will reflect a spherical wave from the feed onto a primary reflector, the primary reflector consisting of any surface of revolution about a primary axis having a focus or quasi-focus on the same side as is positioned the subreflector, such that the beam reflected off of the entire surface of the primary reflector is a co-planar wavefront, which will thus radiate a pencil beam.

Another feature of the present invention resides in the fact that any surface of revolution is suitable for the large primary reflector while the smaller subreflector can be constructed accordingly to fulfill the requirements of the present invention. Thus extensive machining costs and tolerance errors, resulting in beam detraction, can be minimized.

A further feature of the present invention resides in the use of the entire surface of the primary antenna without any aperture blockage, thus increasing antenna gain and removing beam detraction from aperture blockage.

Yet another feature of the present invention resides in defining the surface contour of the subreflector as a plurality of points in an x,y,z coordinate system with an origin on the axis of the primary reflector and the y,z plane rotated an angle $\alpha$ from the axis of the primary reflector, the plurality of points being sufficient in number to enable a computer controlled lathe to machine a smooth contour for the surface of the subreflector.

A conical scanning microwave antenna according to a presently preferred embodiment of the invention intended to substantially incorporate the features noted above includes a primary antenna comprising any axially symmetrical concave surface of revolution having a primary axis corresponding to the axis of revolution and a focus or quasi-focus; a subreflector and feed assembly on the same side of the primary antenna as the focus or quasi-focus and rotatable about the primary axis; and wherein the subreflector has a surface shape such that, at any given location of the subreflector on its locus of rotation, a spherical wave from a typical microwave energy point-source feed will be reflected onto the primary reflector such that the ray from the apex of the subreflector will be incident on the peripheral edge of the primary reflector, normal to the surface of the primary reflector, resulting in a reflected ray back along the same path, parallel to the scanning beam axis, and each ray incident on any point of the primary reflector is reflected parallel to this ray and thus the beam axis and is in phase with this ray in a common aperture plane orthogonal to the beam axis. This is done by the use of mathematic relationships according to the present invention to define the surface of the subreflector as coordinates with reference to a point along the primary axis of the primary reflector.

One particularly novel and useful antenna system in which the present invention is applicable is a Gregorian-corrected zero-scan-loss offset fed paraboloidal reflector with conical scanning capability. Scanning is achieved by revolving the feed and subreflector assembly about the main reflector's axis of revolution. This particular antenna system is a potential candidate for space-born radiometry systems because it provides the required scan-range without moving the main reflector. At the same time, it will greatly reduce the compensation problem of scanning torques generated by having the main reflector physically scanned in two axes.

Examples of the more important features of the present invention have thus been summarized rather broadly in order that the detailed description thereof that follows may be better understood, and in order that the contribution to the art may be better appreciated. There are, of course, additional features of the invention that will be described hereafter which will also form the subject of the appended claims. These features and advantages of the present invention will become apparent with reference to the following detailed description of a preferred embodiment thereof in connection with the accompanying drawings wherein like reference numerals have been applied to like elements, in which:

FIG. 3 shows an elevational view of the primary and subreflectors from along the axis of the reflected beam; and, FIG. 4 shows an elevational view of the primary and subreflectors from along the primary reflector axis.

DETAILED DESCRIPTION OF A PREFERRED EMBODIMENT

A preferred embodiment of the present invention is herein described consisting of a Gregorian-corrected offset feed microwave antenna having a parabolic primary reflector. It will be understood by those skilled in the art that this is by way of example only and that other antenna geometries could be employed and also the primary reflector may be any concave surface of revolution which is axially symmetrical and has a focus or quasi-focus.

Figure 1:
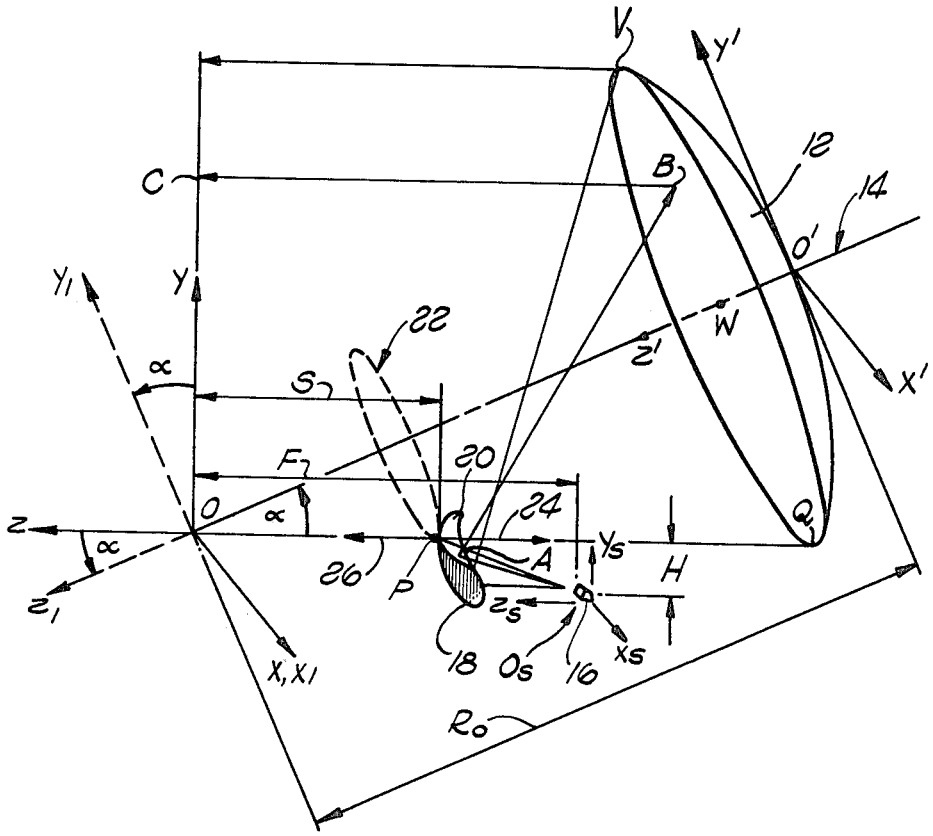
FIG. 1 depicts the geometry of the antenna and subreflector-feed-assembly according to the present invention.

Turning first to FIG. 1, a paraboloidal primary reflector 12 is shown having a primary axis 14. A point source feed 16 supplies a subreflector 18 with microwave energy in a spherical wave form which is reflected onto the primary reflector 12.

The surface 20 of the subreflector 18 is shaped, as will be more fully explained below, so that the wave reflected from the surface of the primary reflector is a co-planar wavefront. The feed 16 and subreflector 18 are fixed with respect to each other forming a subreflector-feed-assembly which may be rotatable about the primary axis of the primary reflector 12, by a suitable rotation means (not shown), for purposes of scanning conically with the fixed parabolic primary reflector 12, along locus 22.

The equation defining the paraboloid in an x',y',z' coordinate system shown in FIG. 1 with its origin 0' at the geometric center of the primary reflector 12 is given by $$z' = \frac{(x')^2 + (y')^2}{4f} \tag{1}$$

where f is the focal length of the paraboloid forming primary reflector 12.

Figure 2:
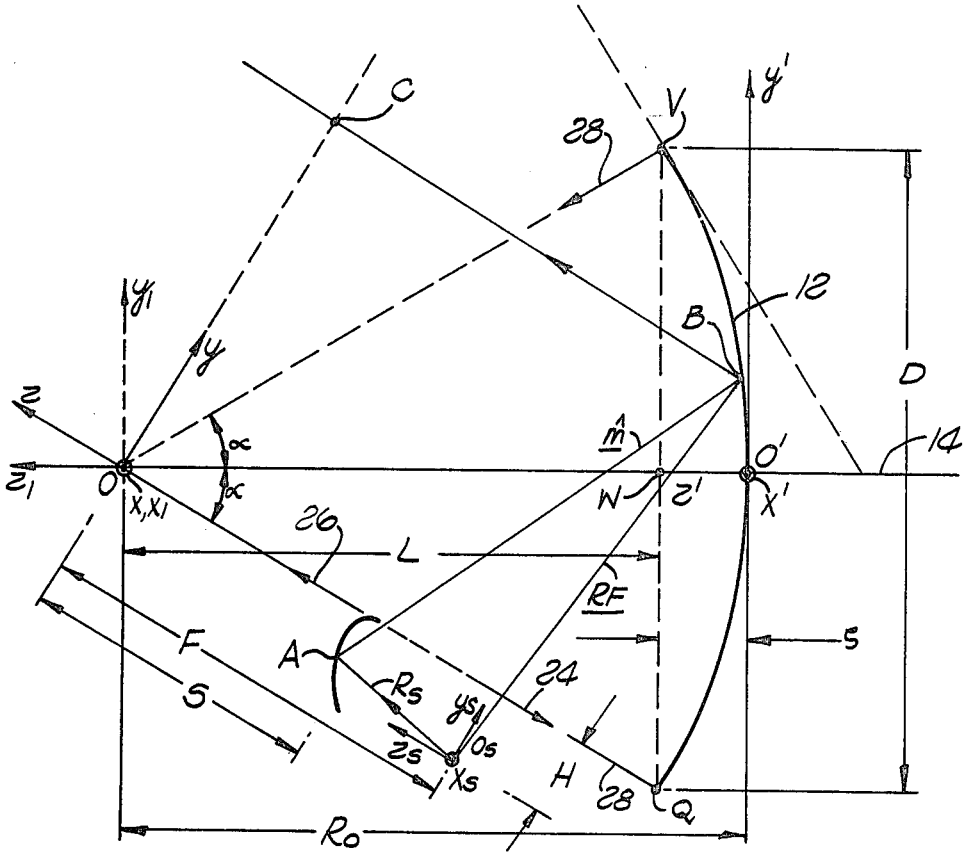
FIG. 2 shows a cross-sectional view of the primary reflector geometry according to the present invention in a plane in which the axis of revolution of the primary reflector lies.

As shown in FIGS. 1 and 2, an x,y,z coordinate system also has its origin at 0 and is rotated about its x axis, colinear with the $x_1$ axis, an angle $\alpha$. The angle $\alpha$ is the scan angle of the reflected beam with respect to the primary axis 14 ($z_1$) of the primary reflector 12. In order for the reflected beam to be co-planar it must be in phase at all planes orthogonal to the beam axis (the z axis). Such an orthogonal plane is the x,y plane in the x,y,z coordinate system. Thus the surface 20 of the subreflector 18 must have a contour such that the reflection of the spherical wave from source 16 will strike each point on the surface of the primary reflector 12 such that the resultant reflection will be parallel to the z axis and each ray within the beam will have traveled an identical distance to any arbitrarily selected aperture plane orthogonal to the z axis, e.g., the x,y plane.

A ray from the subreflector 18 striking primary reflector 12 at Q along the z axis must be normal to the surface of the primary reflector at Q, the point of incidence, in order to reflect back along its own path as shown by arrows 24, 26.

Referring now to FIG. 2 which is a cross-sectional view of the antenna geometry shown in FIG. 1 in the y,z plane, the $y_1,z_1$ plane and the $y_s,z_s$ plane (to be defined below), it can be seen that $$z' = (y')^2/4f \tag{2}$$

and $$\left.\frac{-dz'}{dy'}\right|_{\substack{x'=O \\ y'=\frac{-D}{2}}} = \left.\frac{-d}{dy'}\,\frac{(y')^2}{4f}\right|_{y'=\frac{-D}{2}} = \frac{y'}{2f} = \frac{D}{4f} = \tan \tag{3}$$

wherein $\alpha$ is the angle between the axis of primary reflector 12 and a ray 24 from the peripheral edge of the primary reflector 12 intersecting point 0, and y' and z' are coordinates of a point on the surface of primary reflector in the y',z' plane of an x',y',z' coordinate system aligned with the $x_1,y_1,z_1$ coordinate system, with an origin 0' at the geometric center of the surface of primary reflector 12.

Thus, $$f = y'/2 \tan \alpha \tag{4}$$

the angle $\alpha$ also defines one-half of the scan cone and determines the primary reflector 12 f/D ratio. Thus, if the diameter of the primary reflector 12 is denoted as D, then $$\zeta = D^2/16f \tag{5}$$

where $\zeta$ is the distance 0'-W along the primary axis 14 of primary reflector 12.

Looking back to equation (4) it can be seen that $$f = D/4 \tan \alpha \tag{6}$$

Combining equations (5) and (6) yields $$\zeta = D \tan \alpha/4 \tag{7}$$

From the triangle OWV, then $$L = D/2 \tan \alpha \tag{8}$$

Therefore, $$R_O = L + \zeta = (D/2)/\tan \alpha + (D/2)^2/4f \tag{9}$$

Translating the x',y',z' coordinates to x,y,z coordinates with the z axis along the ray defined by arrows 24,26 in FIG. 1 and parallel to the axis of the pencil beam reflected from primary reflector 12, equation (1) becomes $$z_1 = \frac{(x_1)^2 + (y_1)^2}{4f} - R_o \tag{10}$$

Rotating through angle $\alpha$, equation (10) into the x,y,z coordinate system the dependent variable z (x,y) can then be obtained by solving the quadratic equation $$z^2 \sin^2 + z(2y \sin \alpha \cos \alpha - 4f \cos \alpha) + x^2 + y^2 \cos^2 \alpha + 4fy \sin \alpha - 4fR_o = 0 \tag{11}$$

which is the equation defining the surface of primary reflector 12 in the x,y,z, coordinate system. Alternatively, $$\phi(x_1, y_1, z_1) = \frac{(x_1)^2 + (y_1)^2}{4f} - (R_o - z_1) \tag{12}$$

and after rotation $$\phi(x,y,z) = 1/4f[x^2 + (y \cos \alpha + z \sin \alpha)^2 - 4f(R_O - y \sin \alpha + z \cos \alpha)] \tag{13}$$

from which the main reflector surface normal is determined by $$\hat{n} = -\nabla\phi/|\nabla\phi| \tag{14}$$

As is shown in FIG. 1 the apex P of the subreflector 18 is located at a distance S along the z axis from point 0 at the origin of the x,y,z and $x_1,y_1,z_1$ axes and point 0 is at $R_o$ along the z' axis from point 0' at the origin of the x',y',z' axes. A separate $x_s,y_s,z_s$ coordinate system is located at the point of origin of the source spherical beam from feed 16, and is aligned with the x,y,z coordinate system with its $y_s,z_s$ plane co-planar with the y,z plane, the $y_1,z_1$ plane and the y',z' plane. The origin of the $x_s,y_s,z_s$ coordinate system is located at a distance F from 0, the mutual origin of x,y,z and $x_1,y_1,z_1$ coordinate systems. The origin of the $x_s,y_s,z_s$ coordinate system is also located at a distance H below the z axis in the y,z plane.

Given a point with orthogonal coordinates x,y in the x,y plane, an arbitrary aperture plane, the function defining the surface of the primary reflector can be used to determine the z coordinate and the surface normal to the primary reflector surface.

By revolving the generating function of the primary reflector 12 about the y axis a surface of revolution is produced which is defined as $$\phi(x,y,z) = 0 \tag{15}$$

Returning to equation (14) it can be seen that $$\hat{n}(x,y) = n_x(x,y)\hat{a}_x + n_y(x,y)\hat{a}_y + n_z(x,y)\hat{a}_z \tag{16}$$

where $\hat{a}_x$, $\hat{a}_y$ and $\hat{a}_z$ are unit vectors in the x,y,z coordinate system.

It is desired to have all reflected rays emerge parallel to the z axis and all arrive at the x,y aperture plane in phase to be consistent with the requirements of high gain pencil beam conical scan antenna. Defining $-\hat{m}$ as the direction of a ray from subreflector 18 to point (x,y,z) on primary reflector 12, then by Snell's law $$\hat{m}(x,y) = -a_z + 2[(n)\cdot(\hat{a}_z)]\hat{n} \tag{17}$$

or $$\hat{m}(x,y) = -\hat{a}_z + 2n_z\hat{n} \tag{18}$$

Therefore, $$m_x = 2n_x n_z \tag{19a}$$

$$m_y = 2n_y n_z \tag{19b}$$

$$m_z = -1 + 2(n_z)^2 \tag{19c}$$

To determine the coordinates of incidence of such a particular ray, the vector RF is defined as $$RF = x\hat{a}_x + (y+H)\hat{a}_y + (z+F)\hat{a}_z \tag{20}$$

where H, F, and S are as in FIG. 1.
Further, $$R_s = RF + C(x,y)\hat{m} \tag{21}$$

where C(x,y), assuming a co-planar constant phase wave at the arbitrarily selected (x,y) aperture plane, is determined from the geometric relationships $$O_sA + AB + BC = O_sP + PQ + QO = K \tag{22}$$

where K is constant.
In other words, $$|R_s| + C - z = \sqrt{H^2 + (F-S)^2} + (QO - S) + QO = K \tag{23}$$

Therefore:

$$K = \sqrt{H^2 + (F-S)^2} + 2\,QO - S \tag{24}$$

and, from FIGURE 2, $QO = \frac{D}{2 \sin \alpha}$ thus:

$$K = \sqrt{H^2 + (F-S)^2} + \frac{D}{\text{Sin } \alpha} - S \tag{24a}$$

Further, $$K = |R_s| + C(x,y) - z \tag{25}$$

Thus, $$|R_s|^2 = (K+z)^2 - 2C(K+z) + C^2 \tag{26}$$

since $|R_s| = K + z - C(x/y)$ from equation (25).
In addition $$|R_s|^2 = |RF|^2 + 2C(\hat{m}\cdot RF) + C^2 \tag{27}$$

from equation (21).

Equating equations (26) and (27) and eliminating $C^2$, then $$O=|RF|^2-(K+z)^2+2C(\hat{m}\cdot RF+K+z) \quad (28)$$

or $$C(x,y)=\frac{1}{2}\frac{(K+z)^2-|RF|^2}{(K+z)+(\hat{m}\cdot RF)} \quad (29)$$

Since from equation (17)

$$\hat{m}\cdot RF=m_x x+m_y(y+H)+m_z(z+F) \quad (30)$$

and $$|RF|^2=x^2+(y+H)^2+(z+F)^2 \quad (31)$$

equation (29) simplifies to $$C(x,y)=\frac{1}{2}\frac{(K+z)^2-x^2-(y+H)^2-(z+F)^2}{(K+z)+xm_x+(y+H)m_y+(z+F)m_z} \quad (32)$$

Since $$R_s=x_s\hat{a}_x+y_s\hat{a}_y+z_s\hat{a}_z \quad (33)$$

from equation (21) it can be seen that $$x_s=x+C(x,y)m_x \quad (34a)$$

$$y_s=(y+H)+C(x,y)m_y \quad (34b)$$

$$z_s=(z+F)+C(x,y)m_z \quad (34c)$$

A unit vector in the direction of $R_s$ is defined as $$\hat{r}_s=R_s/|R_s| \quad (35)$$

and using equations (25) and (34a)–(34c)

$$r_s=\frac{x_s\hat{a}_x+y_s\hat{a}_y+z_s\hat{a}_z}{(K+z)-C(x,y)} \quad (36)$$

The direction of the unit vector normal to the subreflector, $\hat{n}_s$ is the negative value of the vector sum of $\hat{m}$ and $\hat{r}_s$, i.e., $$\hat{n}_s=-u/|u| \quad (37)$$

where $$u=\hat{m}+\hat{r}_s \quad (38)$$

Using equations (16) and (36), the value of vector u is completely determinable and the components of $n_s$ are $$n_{sx}=-u_x/\sqrt{u_x^2+u_y^2+u_z^2} \quad (39a)$$

$$n_{sy}=-u_y/\sqrt{u_x^2+u_y^2+u_x^2} \quad (39b)$$

$$n_{sz}=-u_z/\sqrt{u_z^2+u_z^2+u_z^2} \quad (39c)$$

The surface 20 of subreflector 18 is illuminated by a point source 16 assumed to be a standard microwave source which is either linearly polarized or circularly polarized and located at the origin $O_s$ of the $x_s$, $y_s$, $z_s$ coordinate system.

From the above-noted relationships a surface contour for the subreflector can be defined based upon the desired parameters of, e.g., scan angle $\alpha$, f/D ratio and H. Using computer data processing techniques well known to those skilled in the art, the surface of the subreflector can be defined by a desired plurality of x,y,z coordinates of sufficient number to enable a computer controlled lathe, also well known in the art, to produce a smooth surface of the subreflector having the desired contour.

In summary then, the subreflector surface is completely definable by the vector normal to its surface, i.e., from equation (37). Equation (38) gives the values for u employed in equation (37), and equations (33)–(36) provide the $r_s$ term in equation (38) and equations (19a-)–(19c) provide the solution for m in equation (38). Thus the components of the vector normal to the surface at each point on the surface 20 of the subreflector 18 is determinable from equations (39a)–(39c).

FIG. 3 shows the outline of the extremities of the subreflector 18 looking down the primary axis of the primary reflector 12. As would be expected the axially symmetric primary reflector 12 appears circular in this view and the subreflector is shown to be aperture blocking to a pencil beam aligned with the primary axis. However, as shown in FIG. 4, a view along the beam axis, the subreflector 18 is not blocking the main aperture. The ellipsoid aperture is shown and the apex P of the subreflector 18 is aligned along a parallel to the wave axis with the peripheral edge Q of the primary reflector 12. This is true at all points of rotation of the subreflector 18 about the primary axis thus resulting in no aperture blocking as the pencil beam is scanned.

SUMMARY OF THE ADVANTAGES AND SCOPE OF THE INVENTION

It will be appreciated that in constructing a conical scan microwave antenna according to the present invention, certain significant advantages are provided.

In particular the present invention pertains to any axially symmetrical surface of revolution for the primary reflector, giving great flexibility in the selection of primary reflector size and design and facilitating the manufacture of the primary reflector. Further, for any given set of parameters, e.g., scan angle $\alpha$, f/D ratio of the primary reflector, and source location, the present invention enables the production of a subreflector surface which will result in a conically scanable pencil beam which is completely unblocked in its aperture.

The foregoing description of the invention has been directed to a particular preferred embodiment in accordance with the requirements of the Patent Statutes and for purposes of explanation and illustration. It will be apparent, however, to those skilled in the art that many changes and modifications in both the apparatus and method of the present invention may be made without departing from the scope and spirit of the invention. For example, the preferred embodiment described is a Gregorian-corrected antenna system; however, other types of antennas, e.g., Cassegrainian corrected antennas with convex subreflectors are suitable for use with the present invention and may be designed by the use of similar equations. In addition, while the preferred embodiment is described as having a paraboloid primary reflector as has been explained, any axially symmetric surface of revolution is suitable for the primary reflector. It will further be apparent that the invention may also be utilized, with suitable modifications within the state of the art, which will be apparent to those skilled in the art. It is the Applicants' intention in the following claims to cover all such equivalent modifications and variations as fall within the true spirit and scope of the invention:

What is claimed is:

1. In a conical scanning microwave antenna, comprising: a primary reflector, having an axis, and consisting of an axially symmetric surface of revolution about the primary reflector axis, and having a circular peripheral edge, and an aperture plane, defined as the x,y plane in an x,y,z coordinate system with an origin O on the primary reflector axis and rotated an angle $\alpha$ in the y,z plane from the primary reflector axis; a subreflector, which subreflector has an apex; a spherical-wave point source of microwave energy; and, the point source being located at an origin $O_s$ of an $x_s$, $y_s$, $z_s$ coordinate system, wherein the $x_s$, $y_s$, and $z_s$ coordinates are parallel, respectively, to the x, y and z coordinates and the $y_s$, $z_s$ plane is co-planar with the y, z plane, the improvement comprising:

the origin $O_s$ being located a fixed distance, co-linear with $y_s$, below the z axis, an extension of which forms a line in the y,z plane, said line intersecting the primary reflector axis at an angle $\alpha$ and intersecting the circular peripheral edge of the primary reflector normal to the surface of the primary reflector at the point of intersection;

the subreflector being positioned and having a surface contour such that in the transmit mode a ray from the point source reflecting from the subreflector, at the apex, onto the primary reflector, travels along the extension of the z axis and reflects, from the point of intersection of the extension of the z axis and the circular peripheral edge, back along the extension of the z axis and interesects the primary axis at 0 and travels a fixed distance from the point source, to said surface of the subreflector, to said point of intersection with the peripheral edge, to the point of intersection with the primary axis; and, for each ray from the point source incident upon said surface of the subreflector there is a corresponding reflection onto a point on the primary reflector which results in a reflection from the respective point which is parallel to the z axis and has the same distance of travel from the point source, to the subreflector, to the primary reflector, to the x,y plane as did the said ray reflected from the apex of the subreflector.

2. The antenna of claim 1 wherein no portion of the subreflector and the point source is intersected by the wave created by the sum of all said rays.

3. The antenna of claim 1 further comprising:

the subreflector having a surface defined such that, for every ray, represented by the vector $R_s$, originating from the point source origin $O_s$ and incident upon said surface of the subreflector, a unit vector $\hat{n}_s$ normal to said surface of the subreflector is defined, at the point of incidence upon said surface of the subreflector, as $$\hat{n}_s = -u/|u|$$

where:

$$u = \hat{m}_s + \hat{r}_s$$

and where $\hat{r}_s$, a unit vector along $R_s$ is defined as $$\hat{r}_s = \frac{R_s}{|R_s|} = \frac{x_s a_x + Y_s a_y + z_s a_z}{K + z - C(x,y)}$$

wherein $a_x$, $a_y$ and $a_z$ are unit vectors along the x,y,z axes, and C(x,y) is the distance between the point of incidence of the ray on said surface of the subreflector and the point of incidence of the reflected ray upon the primary reflector and is defined as:

$$C(x,y) = \frac{1}{2}\frac{(K+z)^2 - |RF|^2}{(RF \cdot \hat{m}) + K + z}$$

$K$ = a constant $$= \sqrt{H^2 + (F-S)^2} + D/\sin\alpha - S$$

$x_s = x + C(x,y)m_x$ $y_s = y + H + C(x,y)m_y$ $z_s = z + F = C(x,y)m_x$ wherein H is the distance along the $y_s$ axis between the point source and the z axis, F is the coordinate along the z axis of the distance between 0 and the point source, S is the coordinate along the z axis of the distance between 0 and the apex of the subreflector D is the diameter of the primary reflector, and m is a unit vector in the direction from the point of incidence of the reflected ray upon the primary reflector, with $m_x$, $m_y$ and $m_z$ being the x, y, z components of m; and RF is the vector between $O_s$ and the point of incidence upon the primary reflector and is defined as:

$$RF = x\hat{a}_x + (y+H)\hat{a}_y + (z+F)\hat{a}_z.$$

4. The antenna of claim 1 further comprising the subreflector and point source being in a fixed spatial relationship to each other and rotatable about the primary reflector axis such that the apex defines a circular locus having its center on the primary reflector axis, and wherein the z axis defines a conical scan at an angle $\alpha$ from the primary reflector axis and the point of intersection defines a locus about the circular circumferential peripheral edge of the primary reflector.

5. In a conical scanning microwave antenna, comprising: a primary reflector, having an axis, and consisting of an axially symmetrical surface of revolution about the axis, and having a focus on the primary axis and coordinate system with an origin O on the primary axis and rotated at angle $\alpha$ in the y,z plane from the primary axis; a subreflector, which subreflector has an apex, a spherical wave point source of microwave energy; the subreflector and point source being in fixed spatial relation to each other and, together, rotatable about the primary axis; and, the point source being located at $O_s$, the origin of an $x_s$, $y_s$, $z_s$ coordinate system wherein the $x_x$, $y_s$ and $z_s$ coordinates are parallel, respectively, with the x, y and z coordinates, and the $y_s$, $z_s$ plane is co-planar with the y,z plane the improvement comprising:

the subreflector having a surface defined such that, for every ray, represented by the vector $R_s$, originating from the point source origin $O_s$ and incident upon said surface of the subreflector, a unit vector $\hat{n}_s$ normal to said surface of the subreflector is defined, at the point of incidence upon said surface of the subreflector, as:

$$n_s = -u/|u|$$

where:

$$u = \hat{m} + \hat{r}_s$$

and where $r_s$, a unit vector along $R_s$, is defined as $$\hat{r}_s = \frac{R_s}{|R_s|} = \frac{x_s \hat{a}_x + y_s \hat{a}_y + z_s \hat{a}_z}{K + z - C(x,y)}$$

wherein $a_x$, $a_y$ and $a_z$ are unit vectors along the x,y,z axes, and C(x,y) is the distance between the point of incidence of the ray on said surface of the subreflector and the point of incidence of the reflector ray upon the primary reflector and is defined as:

$$C(x,y) = \tfrac{1}{2} \frac{(K+z)^2 - |RF|^2}{(RF \cdot m) + K + z}$$

$K$ = a constant $$= \sqrt{H^2 + (F-S)^2} + D/\sin\alpha - S$$

$x_s = x + C(x,y)m_x$
$y_s = y + H + C(x,y)m_y$
$z_s = z + F = C(x,y)m_x$ wherein H is the distance along the $y_s$ axis between the point source and the z axis, F is the coordinate along the z axis of the distance between 0 and the point source, S is the coordinate along the z axis of the distance between 0 and the apex of the subreflector, D is the diameter of the primary reflector, and m is a unit vector in the direction from the point of incidence of the reflected ray upon the primary reflector, with $m_x$, $m_y$ and $m_z$ being the x, y, z components of m; and RF is the vector between $O_s$ and the point of incidence upon the primary reflector and is defined as $$RF = xa_x + (y+H)a_y + (z+F)a_z.$$

6. In a conical scanning microwave antenna, comprising: a primary reflector, having an axis and consisting of an axially symmetric surface of revolution about the primary reflector axis, and having a peripheral edge, and an aperture plane, defined as the x,y plane in an x,y,z coordinate system with an origin O on the primary reflector axis and rotated an angle $\alpha$ in the y,z plane from the primary reflector axis; a subreflector, which subreflector has an apex; a spherical-wave point source of microwave energy; and, the spherical-wave point source being located at an origin $O_s$ of an $x_s$, $y_s$, $z_s$ coordinate system, wherein the $x_s$, $y_s$, $z_s$ coordinates are parallel, respectively, to the x, y and z coordinates, and the $y_s$, $z_s$ plane is coplanar with the y, z plane, the improvement comprising:

the origin $O_s$ being located a fixed distance, co-linear with $y_s$, below the z axis, an extension of which forms a line in the y,z plane, said line intersecting the primary reflector axis at an angle $\alpha$ and intersecting the peripheral edge of the primary reflector normal to the surface of the primary reflector at the point of intersection with the peripheral edge;

the subreflector being positioned and having a surface contour such that in the transmit mode a ray from the point source reflecting from the subreflector at the apex onto the primary reflector, travels along the extension of the z axis and reflects, from the point of intersection of the extension of the z axis and the peripheral edge, back along the extension of the z axis and intersects the primary reflector axis and travels a fixed distance from the point source, to said surface of the subreflector, to said point of intersection with the pheripheral edge, to the point of intersection with the primary reflector axis; and, for rays from the point source incident upon said surface of the subreflector there are corresponding reflections onto a point on the primary reflector which result in a reflection from that point, which is parallel to the z axis and has the same distance of travel from the point source, to the subreflector, to the primary reflector, to the x,y plane, as did the said ray reflected from the apex of the subreflector;

the subreflector having a surface defined such that for every ray, represented by the vector $R_s$, originating from the point source origin $O_s$ and incident upon said surface of the subreflector, a unit vector $n_s$ normal to said surface of the subreflector is defined, at the point of incidence upon said surface of the subreflector, as $$n_s = -u/|u|$$

where:

$$u = \hat{m}_s + \hat{r}_s$$

and where $\hat{r}_s$, a unit vector along $R_s$ is defined as $$\hat{r}_s = \frac{R_s}{|R_s|} = \frac{x_s \hat{a}_x + Y_s \hat{a}_y + z_s \hat{a}_z}{K + z - C(x,y)}$$

wherein $a_x$, $a_y$ and $a_z$ are unit vectors along the x,y,z axes, and C(x,y) is the distance between the point of incidence of the ray on said surface of the subreflector and the point of incidence of the reflected ray upon the primary reflector and is defined as:

$$C(x,y) = \tfrac{1}{2} \frac{(K+z)^2 - |RF|^2}{(RF \cdot \hat{m}) + K + z}$$

$K$ = a constant $$= \sqrt{H^2 + (F-S)^2} + D/\sin\alpha - S$$

$x_s = x + C(x,y)m_x$
$y_s = y + H + C(x,y)m_y$
$z_s = z + F + C(x,y)m_z$ wherein H is the distance along the $y_s$ axis between the source and the extension of the z axis, F is the coordinate along the extension of the z axis of the distance between 0 and the point source, S is the coordinate along the extension of the z axis of the distance between 0 and the apex of the subreflector, D is the diameter of the primary reflector, and m is a unit vector in the direction from the point of incidence of the reflected ray upon the primary reflector, with $m_x$, $m_y$, and $m_z$ being the x, y and z components of m; and, RF is the vector between $O_s$ and the point of incidence upon the primary reflector and is defined as:

$$RF = x\hat{a}_x + (y+H)\hat{a}_y + (z+F)\hat{a}_z.$$

7. The antenna of claim 6 wherein no portion of the subreflector and the point source is intersected by the wave created by the sum of all said rays.

8. The antenna of claim 6 further comprising the subreflector and point source being in a fixed spatial relation to each other and rotatable about the primary reflector axis such that the apex defines a circular locus having its center on the primary reflector axis, and wherein the z axis defines a conical scan at an angle $\alpha$ from the primary reflector axis and the point of intersection defines a locus abut the circumferential peripheral edge of the primary reflector.

* * * * *

UNITED STATES PATENT AND TRADEMARK OFFICE

CERTIFICATE OF CORRECTION

PATENT NO. : 4,272,769

DATED : June 9, 1981

INVENTOR(S) : Rusch et al

It is certified that error appears in the above—identified patent and that said Letters Patent is hereby corrected as shown below:

IN THE ABSTRACT, line 6, delete "subreflecror" and substitute --subreflector--.

IN THE SPECIFICATION,

Column 7, line 43, in equation 36, delete "$\underline{r}$ =" and substitute --$\hat{\underline{r}}$ =--.

Column 7, line 46, delete "$\hat{n}_s$" and substitute --$\hat{\underline{n}}_s$--.

Column 7, line 46, delete "$\hat{m}$" and substitute --$\hat{\underline{m}}$--.

Column 7, line 47, delete "$\hat{r}_s$" and substitute --$\hat{\underline{r}}_s$--.

Column 7, line 55, delete "u" and substitute --$\underline{u}$--.

Column 7, line 56, delete "$n_s$" and substitute --$\hat{\underline{n}}_s$--.

Column 8, line 14, delete "u" and substitute --$\underline{u}$--.

Column 8, line 16, delete "$r_s$" and substitute --$\hat{\underline{r}}_s$--.

UNITED STATES PATENT AND TRADEMARK OFFICE

CERTIFICATE OF CORRECTION

PATENT NO. : 4,272,769

DATED : June 9, 1981

INVENTOR(S) : Rusch et al

It is certified that error appears in the above-identified patent and that said Letters Patent are hereby corrected as shown below:

Column 8, line 17, delete "m" and substitute --$\hat{m}$--.

IN THE CLAIMS:

Column 9, line 59, delete "$\hat{n}_s$" and substitute --$\hat{n}_s$--.

Column 10, line 1, delete "$\hat{r}_s$" and substitute --$\hat{r}_s$--.

Column 10, line 1, delete "$R_s$" and substitute --$R_s$--.

Column 10, line 6, delete "+ $Y_s a_y$ +" and substitute --+ $y_s a_y$ +--.

Column 10, line 30, delete "m" and substitute --$\hat{m}$--.

Column 10, line 34, delete "RF" and substitute --RF--.

Column 11, line 4, delete "$n_s$" and substitute --$\hat{n}_s$--.

Column 11, line 10, delete "$r_s$" and substitute --$\hat{r}_s$--.

Column 11, line 10, delete "$R_s$" and substitute --$R_s$--.

Column 11, line 25, delete "(RF• m)" and substitute --(RF• $\hat{m}$)--.

UNITED STATES PATENT AND TRADEMARK OFFICE

CERTIFICATE OF CORRECTION

PATENT NO. : 4,272,769

DATED : June 9, 1981

INVENTOR(S) : Rusch et al

It is certified that error appears in the above-identified patent and that said Letters Patent are hereby corrected as shown below:

Column 11, line 39, delete "m" and substitute --$\hat{m}$--.

Column 11, line 43, delete "RF" and substitute --$\underline{RF}$--.

Column 11, line 47, delete "$\underline{RF}=\underline{x}\underline{a}_{\underline{x}}+(\underline{y}+\underline{H})\underline{a}_{\underline{y}}+(\underline{z}+\underline{F})\underline{a}_{\underline{z}}$" and substitute --$\underline{RF}=\underline{x}\hat{\underline{a}}_{\underline{x}}+(\underline{y}+\underline{H})\hat{\underline{a}}_{\underline{y}}+(\underline{z}+\underline{F})\hat{\underline{a}}_{\underline{z}}$--.

Column 12, line 28, delete "$n_{\underline{s}}$" and substitute --$\hat{\underline{n}}_{\underline{s}}$--.

Column 12, line 32, delete "$\underline{n}_{\underline{s}} = \underline{u}/[\underline{u}]$" and substitute --$\hat{\underline{n}}_{\underline{s}} = \underline{u}/[\underline{u}]$--.

Column 12, line 38, delete "$\hat{r}_s$, a unit vector along $R_{\underline{s}}$" and substitute --$\hat{\underline{r}}_{\underline{s}}$, a unit vector along $\underline{R}_{\underline{s}}$--.

Column 12, line 43, delete "$\underline{x}_{\underline{s}}\hat{\underline{a}}_{\underline{x}} + \underline{Y}_{\underline{s}}\hat{\underline{a}}_{\underline{y}} + \underline{z}_{\underline{s}}\hat{\underline{a}}_{\underline{z}}$" and substitute --$\underline{x}_{\underline{s}}\underline{a}_{\underline{x}} + \underline{Y}_{\underline{s}}\underline{a}_{\underline{y}} + \underline{z}_{\underline{s}}\underline{a}_{\underline{z}}$--.

UNITED STATES PATENT AND TRADEMARK OFFICE

CERTIFICATE OF CORRECTION

PATENT NO. : 4,272,769

DATED : June 9, 1981

INVENTOR(S) : Rusch et al

It is certified that error appears in the above–identified patent and that said Letters Patent are hereby corrected as shown below:

Column 12, line 54, before "K = a constant" insert --and--.

Column 12, line 68, delete "m" and insert --m--.

Column 13, line 8, delete "RF" and insert --RF--.

Signed and Sealed this

Sixteenth Day of March 1982

[SEAL]

Attest:

GERALD J. MOSSINGHOFF

Attesting Officer

Commissioner of Patents and Trademarks